United States Patent [19]

Cognata

[11] 4,351,546

[45] Sep. 28, 1982

[54] COVER FOR A CHANNEL CLIP BINDER AND METHOD OF MAKING SAME

[76] Inventor: Richard Cognata, 1268 Sacramento St., San Francisco, Calif. 94108

[21] Appl. No.: 144,393

[22] Filed: Apr. 28, 1980

[51] Int. Cl.[3] ..... B42D 3/00; B42F 9/00

[52] U.S. Cl. ..... 281/45; 412/3; 412/34

[58] Field of Search ..... 281/29, 45; 11/1 R, 11/1 A, 1 B; 402/63, 74; 281/45

[56] References Cited

U.S. PATENT DOCUMENTS

| | | | |
|---|---|---|---|
| 3,347,243 | 10/1967 | Ravenal | 281/49 |
| 3,881,203 | 5/1975 | Giulie | 11/1 AC X |
| 3,947,138 | 3/1976 | Eshelman | 402/60 X |

FOREIGN PATENT DOCUMENTS

| | | | |
|---|---|---|---|
| 820746 | 8/1969 | Canada | 402/74 |
| 1179182 | 10/1964 | Fed. Rep. of Germany | 402/63 |

*Primary Examiner*—Paul A. Bell
*Assistant Examiner*—John S. Brown
*Attorney, Agent, or Firm*—Harry E. Aine

[57] ABSTRACT

In a channel clip report binder of the type wherein the marginal edges of a stack of leaves to be bound together are clipped between a pair of resilient side walls of a channel clip member, a cover is provided by hinging together major and minor portions of front and back cover sheet portions, respectively. The minor portions of each of the front and back cover sheets are bonded to the outer faces of the channel side walls in mutually opposed face-to-face relation. The hinges of each of said front and back cover sheets are disposed generally parallel to and adjacent to the base portion of the channel clip member. In one method of cover construction, a unitary cover sheet is pleated to provide a minor cover portion having one inwardly directed inverted V-shaped pleat adapted to receive the channel clip member. In an alternative method of cover fabrication, a unitary cover sheet is pleated to form a minor cover portion of generally M-shaped cross section having the V-shaped central region of the M-shaped pleat disposed to be received within and clipped within the channel clip member.

12 Claims, 4 Drawing Figures

COVER FOR A CHANNEL CLIP BINDER AND METHOD OF MAKING SAME

BACKGROUND OF THE INVENTION

The present invention relates in general to channel clip report binders and more particularly to an improved cover for same and method of fabricating same.

DESCRIPTION OF THE PRIOR ART

Heretofore, channel clip binders have been utilized for binding reports and the like by pinching a stack of leaves to be bound together along a common marginal edge between a pair of resilient side walls of a channel clip member. The side walls of the channel clip member, typically fabricated as a plastic extrusion, are resiliently inwardly converging toward each other and stand up in laterally spaced relation from an elongated integral base portion or spine of the channel clip. In these prior channel clip binders, the front and back cover sheets are typically made of a durable heavy stock material placed on the top and bottom of the stack of leaves to be bound. The entire stack of leaves, including the cover sheet are clipped together by the channel clip member. One problem with this arrangement is that the cover stock is usually relatively stiff which makes opening and closing of the report awkward as it is difficult for the cover sheets to be folded back into an open position, in other words, the cover sheets tend to close on the report unless held in the open position by the user. Also, the channel binding clip protrudes away from the hinge lines of the front and back covers so that the report covers can not lie flat in the open position on a table top or the like. One example of such a prior art channel clip binder is found in U.S. Pat. No. 3,540,832 issued Nov. 17, 1970. Another example of such a binder is one marketed under the tradename SLIDE-LOCK REPORT COVER available from Kingsbacher-Murphy Company of Torrance, California.

SUMMARY OF THE PRESENT INVENTION

The principal object of the present invention is the provision of an improved cover and method of making same for a channel clip binder.

In one feature of the present invention, each of the front and back cover sheets are hinged together to form major and minor cover portions with the faces of the minor portions bonded to the outer faces of the side walls of the channel clip and with the hinges disposed adjacent the base portion of the channel clip to facilitate opening and closing of the cover.

In another feature of the present invention, the cover of the present invention is fabricated by folding a unitary cover sheet into major front and back portions with minor cover portions disposed therebetween in the form of one inwardly directed inverted V-shaped pleat. A triangularly cross sectional shaped channel clip member is disposed in the inverted V-shaped pleat such that the open apex of the channel is disposed in generally parallel adjacent relation to the apex of said inverted V-shaped pleat. The outer side walls of the channel clip and the minor portions of the cover sheet are then bonded together in mutually opposed face-to-face relation.

In another feature of the present invention, the cover for the channel clip binder is fabricated by pleating a unitary cover sheet so as to form a generally M-shaped cross section minor cover portion hingedly coupled to major front and back cover portions. The central V-shaped pleat region of the M-shaped minor cover portion is inserted within and clipped within the channel clip member. The outer side walls of the channel clip member and the opposed minor cover portions are then bonded together in mutually opposed face-to-face relation.

Other features and advantages of the present invention will become apparent upon a perusal of the following specification taken in connection with the accompanying drawings wherein:

DESCRIPTION OF THE PREFERRED EMBODIMENTS

Figure 1:
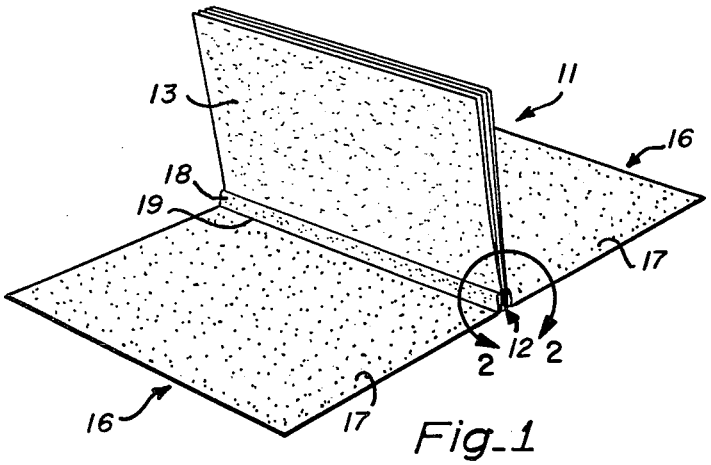
FIG. 1 is a perspective view of a covered channel clip binder in the open position and incorporating features of the present invention.
Figure 2:
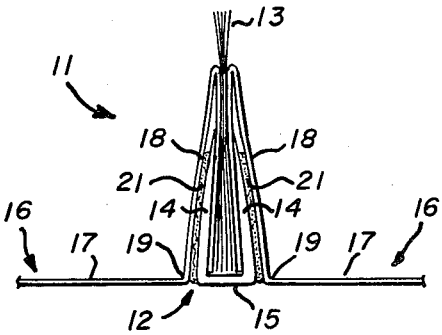
FIG. 2 is an enlarged end view of a portion of the structure of FIG. 1 delineated by line 2—2.

Referring now to FIGS. 1 and 2 there is shown a covered channel clip binder 11 incorporating features of the present invention. Binder 11 includes an elongated channel clip member 12 for binding a plurality of leaves 13 together by pinching a stack of leaves along a common marginal side edge thereof between a pair of upstanding side walls 14 of the channel clip member 12. A suitable channel clip member 12 is commercially available from Kingsbacher-Murphy Company of Torrance, California as a "SLIDE-LOCK REPORT COVER". Preferably, the channel clip member 12 is made of extruded polyvinylchloride plastic with an aluminum transfer foil covering the outer surfaces thereof. Alternatively, the channel member 12 may be aluminized as by coating with aluminum by vacuum evaporation or by sputter coating or by any other well known commercial method.

Figure 3:
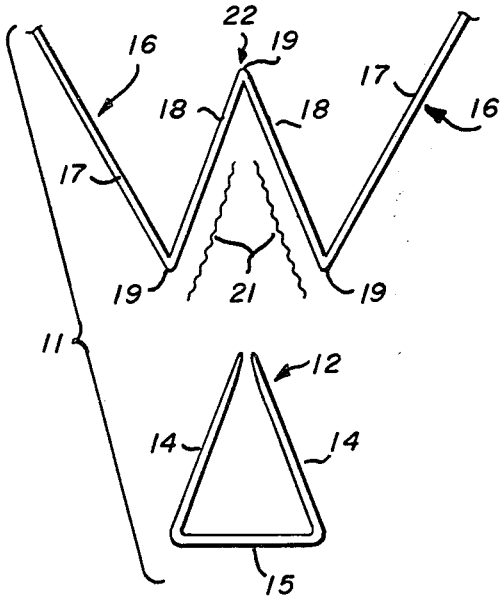
FIG. 3 is an exploded view of a portion similar to that of FIG. 2 depicting a method of fabricating the covered channel clip binder of FIG. 1.
Figure 4:
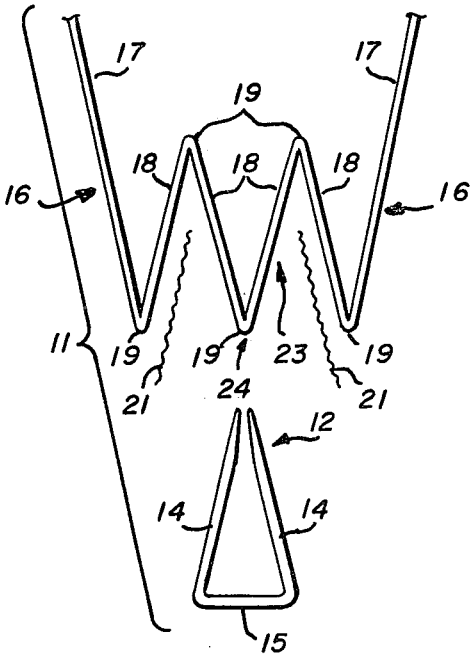
FIG. 4 is an exploded view similar to that of FIG. 3 depicting an alternative method of fabricating the binder of FIG. 1.

The channel clip member 12 is preferably of generally triangular cross section as shown in FIGS. 3 and 4 having a pair of converging side wall members 14 extending upwardly from a base portion 15 in the manner of an isosceles triangle. In a typical example, the channel clip member 12 has a width at its base of approximately $\frac{1}{8}$ inch to hold approximately 30 sheets of stationary 13. The side walls 14 and base member 15 are of equal thickness as of 1/32 inch gauge material, with the side wall members 14 tapering to a thickness of 1/64 of an inch at the open side of the channel. The side walls 14 have a width of approximately $\frac{1}{2}$ inch and the overall length of the channel member 12 is approximately 11 inches. In a second alternative embodiment for holding 60 sheets of stationary 13, the channel clip member 12 has a width at its base 15 of 5/16 inch, the base and side walls are extrude of a material having a thickness of 3/64 of an inch with the side walls tapering to a thickness of 1/32 inch at the open side. The side walls have a width of $\frac{3}{4}$ inch and the channel member 12 is 11 inches long.

Channel clip member 12 and the report pages 13 are covered by means of a cover sheet 16 having front and back major portions 17 hingedly coupled to minor portions 18 along crease or fold lines 19. The crease or fold line 19, which forms the hinge, is disposed adjacent and parallel to the base portion 15 of the channel clip member 12. The minor portions of the cover 18 are bonded to the outer faces of the side walls 14 of the channel 12 by means of a layer of adhesive 21 interposed between the mutually opposed faces of the minor cover portions 18 and the outer faces of the side walls 14.

In a typical example, the cover sheets 16 are made of a relatively heavy weight paper, such as 80 lb. cover weight paper, of various colors. As an alternative, the cover sheets 16 may be made of clear vinyl plastic or the like. The hinges 19 may be made by creasing or by scoring the cover material to provide a flexible hinge 19. The layer of adhesive 21 may conveniently be formed by means of either double sided adhesive tape, such as 3M industrial adhesive transfer tape No. 927, or by suitable adhesive, such as 3M acrylic adhesive liquid No. 9567 (467).

The advantages to the covered channel clip binder 11 of the present invention include, among other things, the ability of the cover to lie flat on a surface in the open position as shown in FIG. 1 so as to facilitate access by the user to the bound pages 13 of the report. This is to be contrasted to the prior art cover for such channel clip binders wherein the cover material comprised merely heavier weight cover pages, one on the front and one on the back of the stack of pages 13. In such a case it was relatively difficult to open the cover and it would not lie flat on a table or the like in a manner as shown in FIGS. 1 and 2. In addition, the cover of the present invention, improves the aesthetic appearance of the covered binder since the cover material covers the outer side walls of the channel clip member 14 leaving exposed only the shiny aluminized base portion 15.

Referring now to FIG. 3 there is shown a preferred method for covering the channel clip binder 12. In this method, a unitary sheet of cover material 16 is folded along crease lines 19 so that the cover has a generally W-shaped cross section defining hinges 19 for dividing each of the front and back cover portions 16 into major and minor portions 17 and 18, respectively. The W-shaped cross section defines a central minor pleated portion of generally inverted V-shape hingedly coupled between the major front and back cover portions 17. The triangularly shaped channel clip member 12 is inserted within the inwardly directed inverted V-shaped minor cover portion 18. The mutually opposed faces of the channel side walls 14 and minor cover portions 18 are bonded together by means of a suitable adhesive layer 21 which may take the form of an adhesive coating applied either to the outer faces of the side walls 14 of the channel clip member 12 or to the outer faces of the minor cover portions 18.

Alternatively, double sided adhesive tape 21 may be applied to the outer faces of the side walls 14 of the channel 12 or to the inwardly directed faces of the minor cover portions 18. The mutually opposed faces of the minor cover portions 18 and the outer 14 are then pressed into engagement to firm up the adhesive bond therebetween. The hinge portion 19 of the minor cover portion 18, which is disposed adjacent and extending along the open ends of the triangular channel clip member 12, is then parted at 22 to provide an access way to receive the stack of leaves 13 to be bound in the channel clip binder 12.

Referring now to FIG. 4 there is shown an exploded view similar to that of FIG. 3 depicting an alternative method for fabricating the covered channel clip binder 11 of the present invention. In this embodiment, a unitary cover sheet 16 is folded along fold lines 19 for defining front and back major cover portions 17 hingedly coupled to an intervening minor cover portion 18 of generally M-shaped cross section, i.e., the minor cover portion 18 is pleated in a generally M-shape. The M-shape of the minor cover portion 18 defines an outwardly directed V-shaped central portion 23. This central portion is pinched together and inserted into the channel clip member 12 so that the apex of the V-shaped portion 23 is disposed adjacent and parallel to the base portion 15 of the channel clip member 12.

The mutually opposed faces of the minor cover portions 18 are then bonded to the mutually opposed outer faces of the side walls 14 in any one of the manners as previously described with regard to FIG. 3, such as by double sided adhesive tape 21 or by a layer of adhesive material deposited either upon the channel member 12 or upon the minor cover portion 18. An advantage to the method of FIG. 4 is that the V-shaped portion 23 of the cover 16 need not be parted in order to provide an access way for insertion of the stack of pages 13 into the channel clip binder 12. However, if desired, the V-shaped portion 23 may be parted at 24 either before or after insertion into the channel clip member 12.

What is claimed is:

1. In a method for covering a channel clip binder of the type wherein the marginal edges of a stack of leaves to be bound together are clipped between a pair of resilient side walls of a channel clip member having said side walls resiliently inwardly converging toward each other and upstanding in laterally spaced relation from an elongated integral base portion of the channel clip member, the steps of:

hinging together major and minor portions respectively of both front and back cover sheet portions of a cover, and adhesively bonding the faces of said minor cover portions to the outer faces of the side walls of the channel clip member in mutually opposed face-to-face relation with the hinges of each of said front and back cover portions being disposed generally parallel to and adjacent said base portion of the channel clip member, whereby opening and closing the covered clip binder is facilitated.

2. The method of claim 1 wherein the step of adhesively bonding the faces of said minor cover portions to said channel side walls includes the step of, interposing strips of double sided adhesive tape between the faces of said minor cover portions and the mutually opposed outer faces of said channel side walls.

3. The method of claim 1 wherein the step of adhesively bonding the faces of said minor cover portions to the faces of said channel side walls includes the step of:

interposing a layer of adhesive between the faces of said minor cover portions and the mutually opposed faces of said channel side walls.

4. The method of claim 1 wherein the step of hinging together said major and minor portions of each of said front and back cover sheet portions includes the step of:

folding each of said front and back cover sheet portions along lines to divide each of said front and back cover sheet portions into major and minor portions hingedly coupled together along respective ones of said fold lines.

5. The method of claim 1 wherein the step of hinging together said major and minor portions of each of said front and back cover sheet portions includes the step of: folding a unitary cover sheet into a pair of pleats to divide the unitary cover sheet into major front and back cover portions with said minor cover portions disposed therebetween in the form of an inwardly directed inverted V-shaped pleat, wherein the step of bonding the faces of said minor cover portions to the outer faces of said channel side walls includes the step of disposing a generally triangularly shaped cross section channel member in said one inwardly directed inverted V-shaped pleat with the open apex portion of said triangularly shaped channel being disposed in generally parallel adjacent relation to the apex of said inverted V-shaped pleat, interposing a layer of adhesive between said mutually opposed faces of said channel side walls and the faces of said inverted V-shaped minor portions of said cover sheet for bonding said minor cover sheet portions to said channel clip member and longitudinally parting said apex region of said inverted V-shaped pleat to provide an entry way for the leaves which are to be bound together to be inserted through said parted cover and to be clipped between said resilient side walls of said channel clip member.

6. The method of claim 5 wherein the step of interposing a layer of adhesive between said mutually opposed faces of said channel side walls and of said inverted V-shaped minor portions of said cover sheet includes the step of, interposing double sided adhesive tape between said mutually opposed faces of said inverted V-shaped pleat and said outer surfaces of said channel side walls.

7. The method of claim 5 wherein the step of interposing a layer of adhesive between said mutually opposed faces of said channel side walls and the faces of said inverted V-shaped pleated minor portion of said cover sheet includes the step of, coating the outer faces of said side walls of said channel clip member with a layer of adhesive.

8. The method of claim 1 wherein the step of hinging together said major and minor portions of each of said front and back cover sheet portions includes the step of, folding a unitary cover sheet into three pleats to divide the unitary cover sheet into major front and back cover portions with minor cover portions disposed therebetween in the form of a pleated minor cover region of generally M-shaped cross section, thereby defining one centrally located outwardly directed V-shaped pleat region disposed between a pair of outer wing portions, and wherein the step of bonding the faces of said minor cover portions to the outer faces of said channel side walls includes the step of:

disposing said outwardly directed V-shaped pleat region of said minor cover portion inside said triangularly shaped channel clip member with the apex region of said V-shaped pleat region being disposed adjacent and generally parallel to the base portion of the channel clip member, and interposing a layer of adhesive between said mutually opposed faces of said channel side walls and the opposed faces of said outer wing portions of said M-shaped pleated region of said minor cover portion for bonding said minor cover sheet portions to said channel clip member.

9. The method of claim 8 wherein the step of interposing a layer of adhesive between said mutually opposed faces of said channel side walls and the faces of said wing portions of said cover sheet includes the step of, interposing double sided adhesive tape between said mutually opposed faces of said outer wing pleat portions and said outer faces of said channel side walls.

10. In a covered channel clip binder:

channel clip means for clipping the marginal edges of a stack of leaves to be bound between a pair of inwardly converging resilient side wall portions of said channel clip means, said side wall portions being inwardly converging toward each other and upstanding in laterally spaced relations from an elongated integral base portion of said channel clip means;

means for hinging together major and minor portions of each of a pair of front and back cover sheet portions, and means for adhesively bonding faces of said minor cover portions to the outer faces of said channel side walls in mutually opposed face-to-face relation and with said hinge means of each of said front and back covers being disposed generally parallel to, and adjacent to said base portion of said channel clip means, whereby opening and closing the cover of the covered binder is facilitated.

11. The cover of claim 10 wherein said means for adhesively bonding faces of said minor cover portions to the outer faces of said channel side walls includes a layer of adhesive interposed between faces of said minor cover portions and the mutually opposed faces of said channel side walls.

12. The cover of claim 11 wherein said hinging means comprises creases along each of said front and back cover sheet portions to divide each of said front and back cover sheet portions into major and minor portions hingedly coupled along said creases.

* * * * *